US009820551B2

(12) United States Patent
Ellsworth et al.

(10) Patent No.: US 9,820,551 B2
(45) Date of Patent: Nov. 21, 2017

(54) PACKAGE FOR CONSUMER CARE PRODUCTS

(71) Applicant: The Procter & Gamble Company, Cincinnati, OH (US)

(72) Inventors: Justin Alan Ellsworth, Sharonville, OH (US); Kerry Lloyd Weaver, Florence, KY (US); Christopher Lawrence Smith, Liberty Township, OH (US); Richard Lawrence Horstman, Cincinnati, OH (US); Julie OiLun Lim, West Chester, OH (US); Ricky V. Retherford, Haw River, NC (US); John Joseph Rego, Ripley, OH (US); Timothy David Reichling, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 8 days.

(21) Appl. No.: 14/971,943

(22) Filed: Dec. 16, 2015

(65) Prior Publication Data

US 2016/0174687 A1 Jun. 23, 2016

Related U.S. Application Data

(60) Provisional application No. 62/095,102, filed on Dec. 22, 2014, provisional application No. 62/114,952, filed on Feb. 11, 2015.

(51) Int. Cl.
*B43K 21/08* (2006.01)
*A45D 40/12* (2006.01)
(Continued)

(52) U.S. Cl.
CPC ..... *A45D 40/12* (2013.01); *A45D 40/02* (2013.01); *A45D 40/04* (2013.01); *B65D 83/0011* (2013.01)

(58) Field of Classification Search
CPC ..... A45D 40/04; A45D 40/02; B65D 83/0011
(Continued)

(56) References Cited

U.S. PATENT DOCUMENTS 3,061,084 A 10/1962 Tibbitts
3,912,403 A 10/1975 Gjerloff
(Continued)

FOREIGN PATENT DOCUMENTS

DE 31 39 192 A1 4/1983
EP 0 818 964 A1 1/1998
(Continued)

OTHER PUBLICATIONS

International Search Report and Written Opinion of the International Searching Authority , PCT/US2015/065945, dated Mar. 23, 2016, 11 pages.
(Continued)

*Primary Examiner* — Jennifer C Chiang
(74) *Attorney, Agent, or Firm* — Kathleen Y. Carter; Betty J. Zea

(57) ABSTRACT

A consumer care product includes a dispensing package. The dispensing package includes a product chamber and an outer jacket surrounding the product chamber. The product chamber includes a movable elevator platform operatively associated with a spindle of a screw assembly. The product chamber or the outer jacket includes a ratchet non-removably associated with the outer jacket or the product chamber.

20 Claims, 8 Drawing Sheets

(51) Int. Cl.
*A45D 40/04* (2006.01)
*B65D 83/00* (2006.01)
*A45D 40/02* (2006.01)

(58) Field of Classification Search
USPC ..... 401/68, 75
See application file for complete search history.

(56) References Cited

U.S. PATENT DOCUMENTS

| | | | | |
|---|---|---|---|---|
| 4,605,330 | A * | 8/1986 | Crowley | A45D 40/04 401/175 |
| 4,865,231 | A | 9/1989 | Wiercinski | |
| 4,950,094 | A | 8/1990 | Yorks | |
| 5,000,356 | A | 3/1991 | Johnson et al. | |
| 5,275,496 | A | 1/1994 | Fattori et al. | |
| 5,547,302 | A | 8/1996 | Dornbusch et al. | |
| 5,725,133 | A | 3/1998 | Iaia | |
| 5,868,510 | A | 2/1999 | Lacout et al. | |
| 5,879,096 | A | 3/1999 | Franta et al. | |
| 5,947,621 | A | 9/1999 | Szekely | |
| 5,961,007 | A | 10/1999 | Dornbusch et al. | |
| 5,967,683 | A | 10/1999 | Fattori | |
| 6,039,483 | A | 3/2000 | Szekely | |
| 6,116,803 | A | 9/2000 | Szekely et al. | |
| 6,143,284 | A | 11/2000 | Bush et al. | |
| 6,299,369 | B1 | 10/2001 | Baines et al. | |
| 6,550,999 | B2 | 4/2003 | Petit et al. | |
| 6,592,278 | B1 | 7/2003 | Holthaus | |
| 6,598,767 | B2 | 7/2003 | Baines et al. | |
| 6,817,799 | B1 | 11/2004 | Petit | |
| 6,820,776 | B2 | 11/2004 | Hemming et al. | |
| 7,086,564 | B1 * | 8/2006 | Corrigan | A45D 33/26 222/39 |
| 7,374,360 | B1 | 5/2008 | Szekely | |
| 7,389,894 | B2 | 6/2008 | Danne et al. | |
| 8,096,724 | B2 | 1/2012 | Bolander et al. | |
| 8,187,578 | B2 | 5/2012 | Walling et al. | |
| 8,388,249 | B2 | 3/2013 | Groh et al. | |
| 8,511,922 | B2 | 8/2013 | Prischak | |
| 8,690,467 | B2 | 4/2014 | Baines et al. | |
| 8,727,651 | B2 | 5/2014 | Arai et al. | |
| 8,821,056 | B2 | 9/2014 | Walling et al. | |
| 8,875,955 | B2 | 11/2014 | Arora et al. | |
| 8,899,860 | B2 | 12/2014 | Baines et al. | |
| 8,961,048 | B2 | 2/2015 | Baines et al. | |
| 2002/0067949 | A1 | 6/2002 | Melnik et al. | |
| 2009/0324317 | A1 | 12/2009 | Batchelor et al. | |
| 2010/0196079 | A1 | 8/2010 | Bolander et al. | |
| 2013/0039687 | A1 | 2/2013 | Bolander et al. | |
| 2014/0154197 | A1 | 6/2014 | Swaile et al. | |
| 2016/0174683 | A1 | 6/2016 | Ellsworth | |
| 2016/0174684 | A1 | 6/2016 | Ellsworth | |
| 2016/0174685 | A1 | 6/2016 | Ellsworth | |
| 2016/0174686 | A1 | 6/2016 | Ellsworth | |

FOREIGN PATENT DOCUMENTS

| | | |
|---|---|---|
| FR | 2 573 734 A1 | 5/1986 |
| JP | 2011-50521 A | 3/2011 |

OTHER PUBLICATIONS

International Search Report and Written Opinion of the International Searching Authority , PCT/US2015/065950, dated Mar. 23, 2016, 11 pages.
International Search Report and Written Opinion of the International Searching Authority , PCT/US2015/065952, dated Mar. 23, 2016, 11 pages.
International Search Report and Written Opinion of the International Searching Authority , PCT/US2015/066038, dated Mar. 18, 2016, 11 pages.
International Search Report and Written Opinion of the International Searching Authority , PCT/US2015/066046, dated Mar. 18, 2016, 11 pages.

* cited by examiner

PACKAGE FOR CONSUMER CARE PRODUCTS

FIELD

This disclosure relates to packages for consumer care products and methods of manufacturing the same. The packages are particularly suited for antiperspirant and/or deodorant products, but can equally be employed for other types of consumer care products.

BACKGROUND

Traditionally, consumer care products such as antiperspirants and/or deodorant products are packaged in an oval or round plastic barrel component. The top of the barrel is open to allow the product to be exposed and dispensed for use, while the opposite, i.e. bottom, end of the barrel contains a mechanism (e.g., a product support elevator coupled with a hand-rotatable screw) to assist in the dispensing of the product.

Antiperspirant and deodorant compositions are offered by manufacturers in a variety of sizes and product forms such as liquids, creams, gels, semi-solids, and solid sticks. These products have different ingredients, active levels, solvents, viscosities, shapes, sizes, and fill volumes to address a variety of consumer preferences and needs. In this regard, manufacturers desire a more efficient way of producing these numerous product offerings, especially under a single brand.

Currently, manufacturers may use different size barrels to accommodate different fill volumes. Alternatively, manufacturers may accommodate different fill volumes by changing the spindle and/or the elevator designs. A change in one molded component of the packaging requires adaptations of the other components. Each packaging design must be adapted to avoid manufacturing, shipping, storage, and dispensing problems that are associated with these different product offerings. For example, different fill volumes for compositions may exhibit different stability profiles, may apply different internal pressures on the package, may require air-tight seals, may cause different degrees of solvent syneresis or weeping, and may require different package designs for ease of and consistent dosing of the composition.

In addition, manufactures have historically used a large number of injection molding parts to make different packaging components for the various product offerings. As a result, sometimes as many as 50-75 or more different molds must be developed, used, and maintained in the injection molding process. Thus, multiple product offerings to consumers present a major challenge to manufacturers.

Thus, a need exists for interchangeable package components to accommodate different fill volumes within a single package and/or product chamber configuration. The use of the same mold parts to manufacture packages that accommodate different fill volumes reduces manufacturing cost and complexity since fewer injection molds are needed. Also, manufacturing may be consolidated to fewer manufacturing lines. These advantages are provided while still providing a dispensing packaging demonstrating adequate strength, flexibility, aesthetic appearance, stability, and dispensing consistency for a variety of product offerings.

SUMMARY

The present disclosure is directed to consumer care products and/or packages. In accordance with one of the embodiments, a package for consumer care products and methods of manufacturing the same are provided. The packages are particularly suited for antiperspirant and/or deodorant products, but can equally be employed for other types of consumer care products.

In an embodiment, a consumer care product includes a dispensing package. The dispensing package includes a product chamber and an outer jacket surrounding the product chamber. The product chamber includes a movable elevator platform operatively associated with a spindle of a screw assembly. The product chamber or the outer jacket includes a ratchet non-removably associated with the outer jacket or the product chamber.

BRIEF DESCRIPTION OF THE DRAWINGS

While the specification concludes with claims that particularly point out and distinctly claim the invention, it is believed that the present invention will be better understood from the following description of embodiments, taken in conjunction with the accompanying drawings in which:

DETAILED DESCRIPTION

Figure 1:
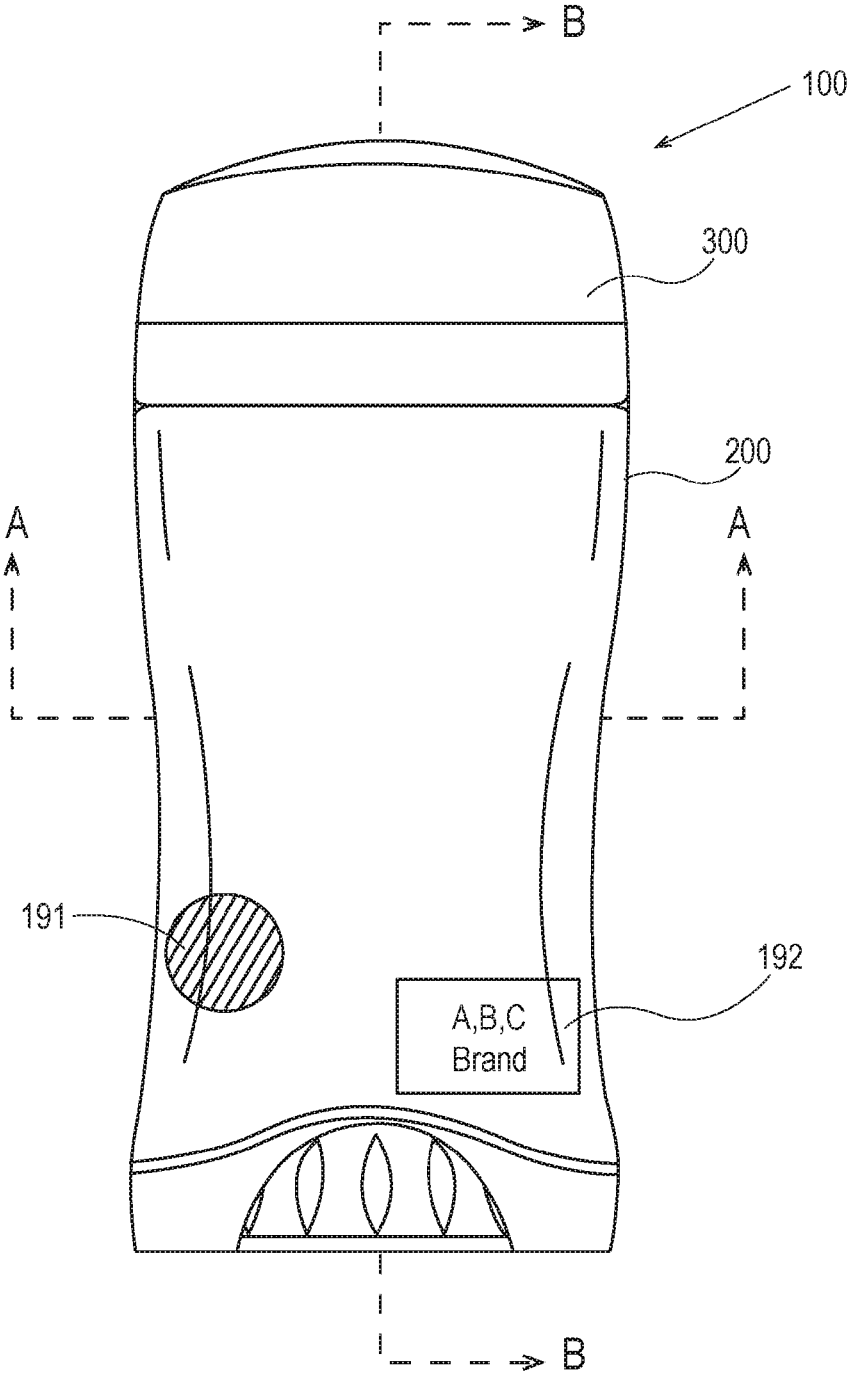
FIG. 1 is a front view of an illustrative consumer care product and dispensing package according to one or more embodiments shown and described herein.

While the specification concludes with the claims particularly pointing out and distinctly claiming the invention, it is believed that the present invention will be better understood from the following description.

As used herein, "consumer care product", which may also be referred to as the "product", refers to any consumer care product, including, but not limited to, beauty care products, household care products, health care products, pet care products, and the like.

"Antiperspirants", as used herein, includes antiperspirants, deodorants, deodorant/antiperspirants and body sprays, and may also be considered as beauty care products.

The term "translucent", as used herein may include "frosted", "glittered", "pearlescence" and the like and is defined herein as the practice of inducing a low level of light scattering into an otherwise "clear" material causing the material to become matted in appearance.

As used herein, "substantially opaque" refers to the ability to sufficiently block the transmission of light so that bodies lying behind are not easily perceivable. Substantially opaque includes "tinted" and is defined herein as the practice of adding a low level of pigment or dye into a material for the purpose of imparting a color into the material.

As used herein, "identifier" relates to a means for communicating between the consumer and the consumer care product such that the consumer may readily identify the consumer care product and its associated traits, including, but not limited to product form, product performance, scents and the like. Identifiers of the present invention may include, but are not limited to, pressure sensitive labels; shrink wrap labels; indicia; colors or other visually detectable or discernable aspects (e.g., "sparkles" or "glitter" via incorporation of interference pigments) that are part of the material from which the packaging components are made or that is subsequently added to the manufactured components; defined relief, indentation, windows and/or gaps formed in the components during or after their manufacture; cast designs, including but not limited to novelty casting to identify characters, paraphernalia, animals, and the like; particular shapes or other means of decoration and/or information sharing used to identify and distinguish the product. The identifiers may be formed concurrently with the manufacture of the components with which they are associated, may be introduced during the manufacture of the components, and/or may be formed or applied to the components after the components are manufactured. The identifiers of the present invention may be the same or different from one another.

As used herein, "novelty cast" may include, but is not limited to, casts/shapes that replicate cars, sport balls, animals or people figures, characters, logos, sport paraphernalia (e.g., helmets, bats, jerseys, shoes and the like), fashion accessories and the like.

By "brand sub line" it is meant a line of products that are targeted to a particular consumer sub-group, provides a real or perceived distinctive benefit, and/or manifests a real or perceived distinctive attribute. By way of example, a consumer care product may be an antiperspirant/deodorant product with the sub lines including, a sensitive skin line, a botanical line, a high performance/high efficacy line, and a no fragrance line. Another example of sub lines may include a "treatment" line that comprises treatments to address extreme personal care conditions (e.g., malodor, excessive perspiration (hyperhidrosis), excessive dandruff, excessive dryness, or oiliness), a "high performance" line that targets superior performance as compared to other offered products, an "essentials" line that provides value-added, trusted or reliable performance, and an "expressives" line that provides sensorial experiences with reliable performance. There may be a single product form or multiple product forms within a given sub line. For example, antiperspirant and deodorant products can come in a variety of forms, including solids, soft solids, gels, and roll-ons. Various sub lines may include the same or different product forms and may include the same number or a different number of product forms. The consumer care product may include a single source identifier (e.g. single brand name) for the multiple sub lines.

FIG. 1 is a front elevation of one embodiment of a dispensing package 100 of a consumer care product as fully assembled. The dispensing package 100 comprises an outer cap 300, an outer jacket 200, a source identifier 192, and an identifier 191.

Figure 2:
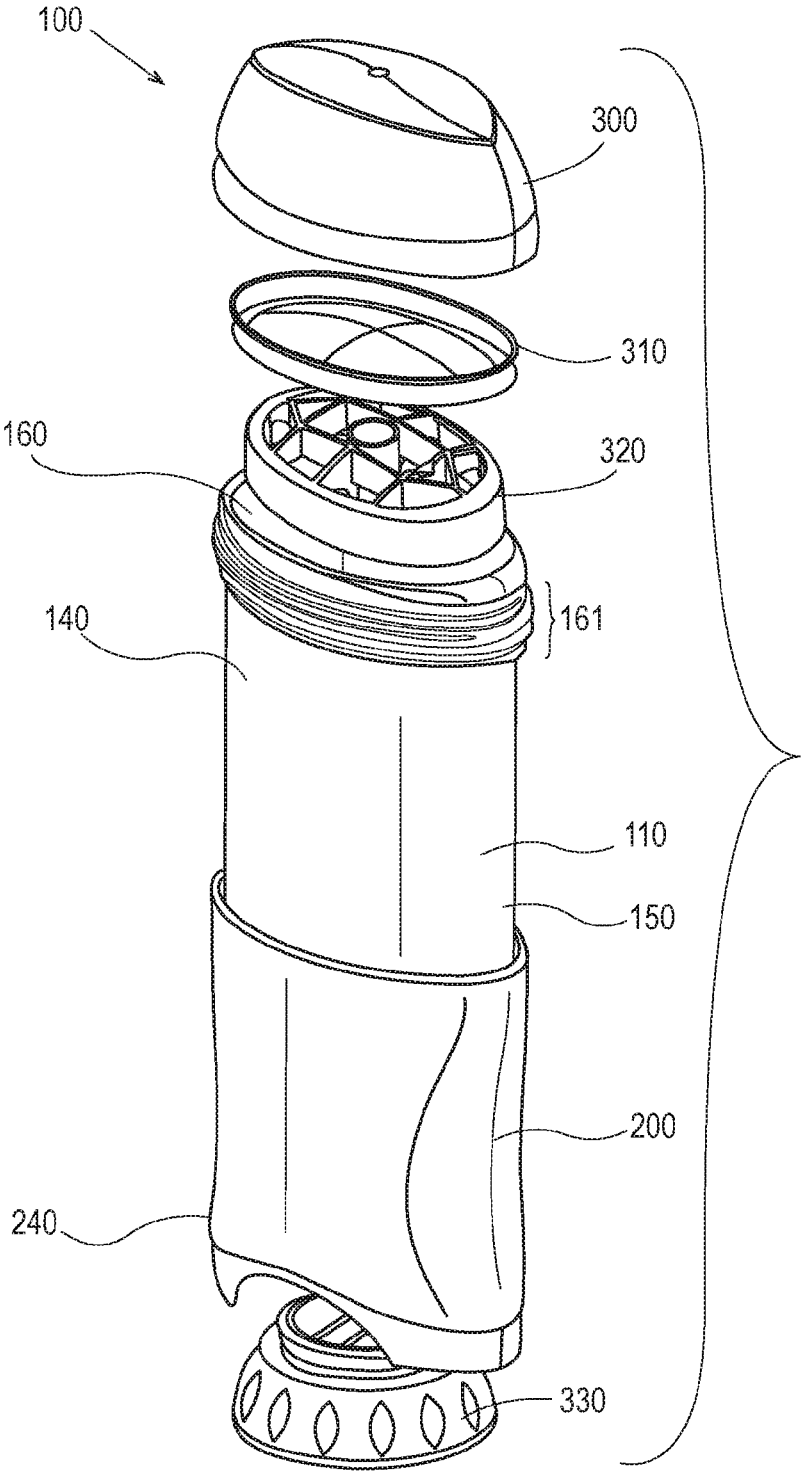
FIG. 2 is an exploded perspective view of an illustrative dispensing package for consumer care product, illustrating some of the individual components and having a form suitable for bottom filling according to one or more embodiments shown and described herein.

FIG. 2 is an exploded perspective view of FIG. 1 of a dispensing package 100 for consumer care product shown and described herein, illustrating some of the individual components. FIG. 2 shows generally one embodiment where the dispensing package 100 may comprise at least one product chamber 110 and an outer jacket 200 for dispensing a consumer care composition. The dispensing package 100 further comprises an outer cap 300, optionally a seal component 310, a movable elevator platform 320, and a screw assembly 330.

The consumer care composition may be in the form of a solid, semi-solid, liquid, gel, mousse or the like. Held within surrounding walls of the product chamber 110, the composition may be dispensed from a top opening 160 of the product chamber 110 and from a top ridged opening 161, both located at a dispensing end 140 of the product chamber 110.

Figure 3:
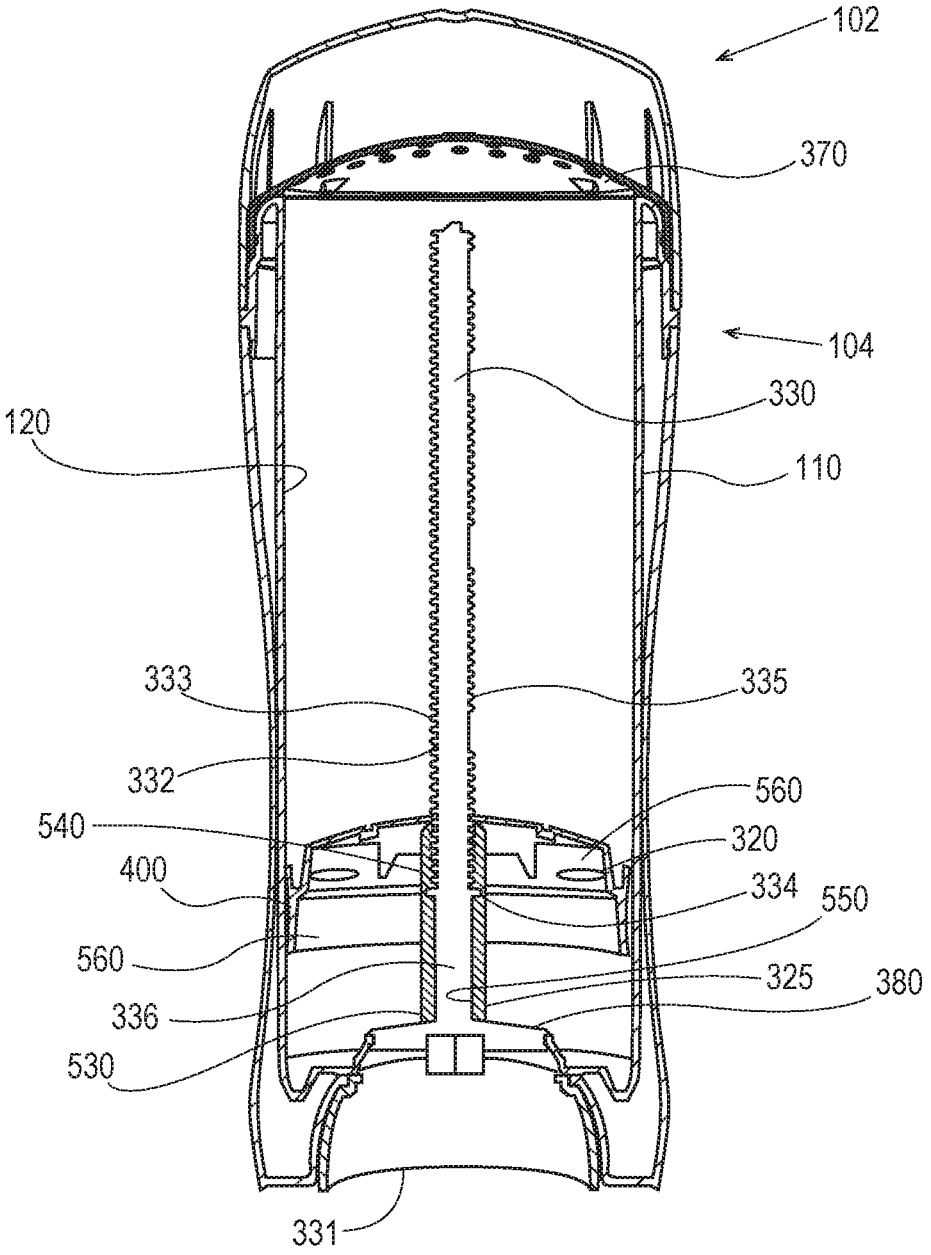
FIG. 3 is cross-sectional front view taken along a major axis of an illustrative dispensing packaging with a movable elevator platform at a first fill volume position according to one or more embodiments shown and described herein.
Figure 4:
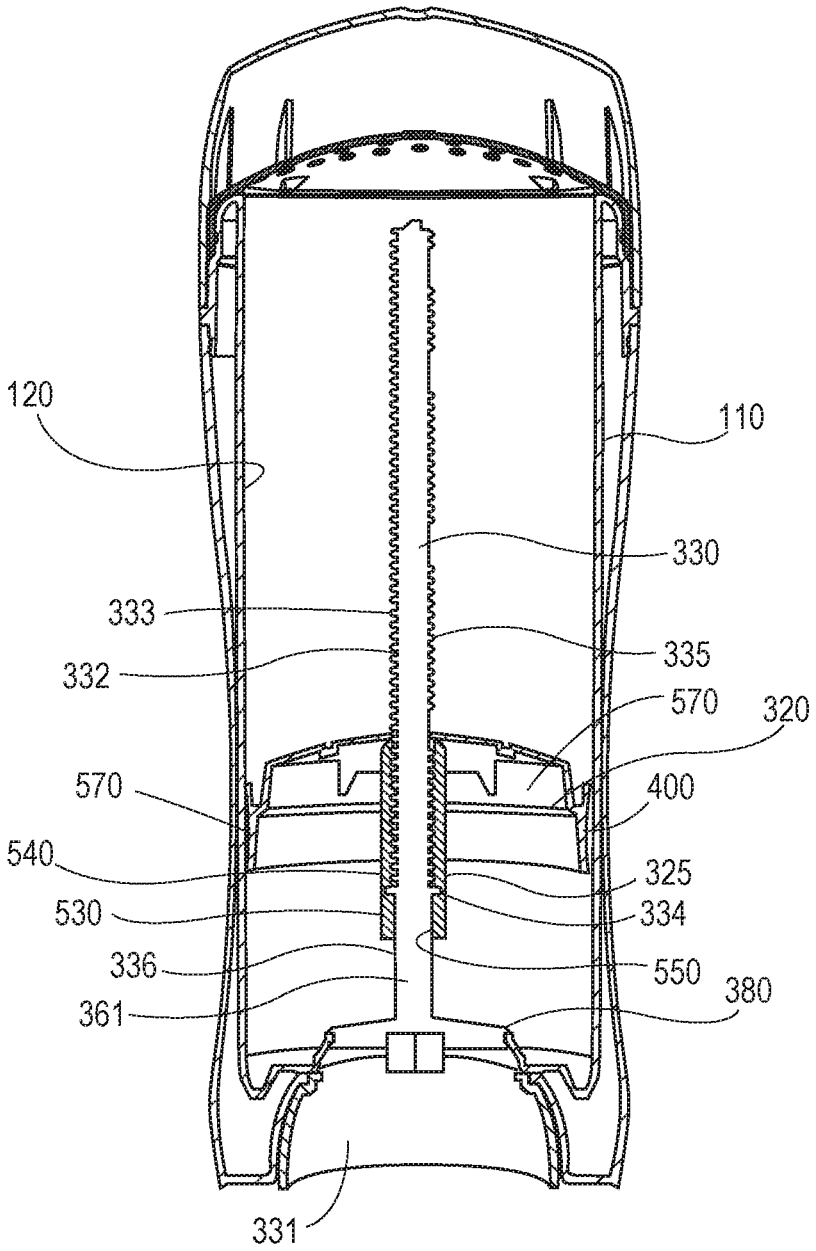
FIG. 4 is cross-sectional front view taken along a major axis of an illustrative dispensing packaging with a movable elevator platform at a second fill volume position according to one or more embodiments shown and described herein.

FIGS. 3 and 4 are cross-sectional front views taken along the major axis of one embodiment of the dispensing packaging. FIG. 3 depicts the moveable elevator platform at a first fill volume position 560. FIG. 4 shows the moveable elevator platform at a second fill volume position 570.

As shown in FIGS. 3 and 4, a movable elevator platform 320 comprises a coupling sleeve 325 having a non-threaded section 530 and a threaded section 540 along an inner surface 550 of the coupling sleeve 325. The dispensing packaging further comprises a screw assembly 330 comprising a spindle 332 that supports the helical threads 333, a seal 334 extending around the circumference of the spindle 332, and a threaded first portion 335 coupled to the threaded section 540 along the inner surface of the coupling sleeve 325 of the movable elevator platform 320. The screw assembly 330 further comprises a non-threaded second portion 336. In this embodiment, the seal 334 frictionally engages with the non-threaded section 530 of the coupling sleeve 325, providing a seal that otherwise is maintained during the advancement of the movable elevator platform 320 along an axis from a first fill volume position 560 to a second fill volume position 570. In one embodiment, the seal 334, which frictionally engages with the non-threaded section 530 of the coupling sleeve 325, provides a seal that substantially prevents air and/or liquid from passing between the seal 334 and the non-threaded section 530 of the coupling sleeve 325. In another embodiment, the frictional engagement of the seal 334 (or the seal 334) is maintained for a distance corresponding to the distance that the movable elevator platform 320 moves along an axis from a first fill volume position 560 to a second fill volume position 570, the distance being from about 0.1 inch to about 1.0 inch, and/or from about 0.2 inch to about 0.6 inch.

Figure 5:
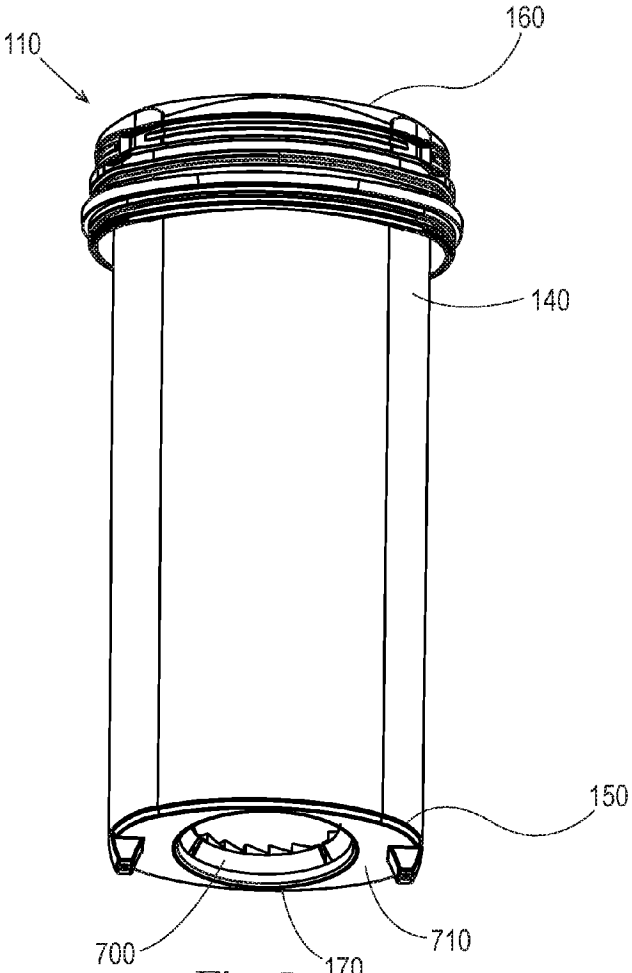
FIG. 5 is a perspective, front view of a product chamber according to one or more embodiments shown and described herein.

Also as shown in FIGS. 4 and 5, the non-threaded section 530 of the movable elevator platform 320 is at the lower end of the inner surface 550 of the coupling sleeve 325 and the threaded section 540 is at the upper end of the inner surface 550 of the coupling sleeve 325. The movable elevator platform 320 further comprises a rim 400 that is in frictional contact with the inner surface 120 of the product chamber 110 along the product chamber major axis 180 and minor axis 190. In an embodiment, the seal 334 extends beyond the outer surface 361 of the spindle 332. The seal 334 may have a first diameter and the inner surface 550 of the non-threaded section 530 of the coupling sleeve 325 has a second diameter, wherein the first diameter is greater than the second diameter.

In some embodiments, the seal 334 may comprise a continuous bead around the circumference of the outer surface 361 of the spindle 332, as shown in FIGS. 4 and 5. Alternatively, the seal 334 may be a thread that is dimensioned to frictionally engage with the inner surface 550 of the non-threaded section 530 of the coupling sleeve 325, thereby providing a seal. The movable elevator platform 320 advances along an axis from a first fill volume position 560 to a second fill volume position 570.

In some embodiments, the dispensing packaging 100 further comprises a ratchet platform 380. The non-threaded second portion 336 of the spindle 332 extends from the ratchet platform 380 to the seal 334 for a distance of about 5 mm to about 45 mm, from about 8 mm to about 35 mm, or from about 10 mm to about 30 mm.

The spindle 332 may be separately molded and attached to the screw base 331 or the spindle 332 may be molded integrally with the screw base 331.

In one embodiment, the fill volume provides a composition volume of from about 5 ml to about 200 ml, from about 25 ml to about 150 ml, from about 40 ml to about 100 ml, and/or from about 50 ml to about 80 ml. In one embodiment, the second fill volume position 570 is about 1% to about 30% greater, about 5% to about 25% greater, and/or about 10% to about 20% greater, than the first fill volume position 560 of the same size package. In one embodiment, the first fill volume position 560 provides a composition volume from about 15 ml to about 60 ml, or from about 25 ml to about 50 and the second fill volume position 570 provides a composition volume from about 70 ml to about 200 ml or from about 75 ml to about 100 ml.

The size of the package depends, in pan, upon the composition to be dispensed, the dose at which it is applied, the dispenser's intended life, the intended use (e.g., value size, samples, travel size, and the like). The volume of the product chamber 110 will typically be larger than the volume of consumer care composition to accommodate component features and production requirements.

In one embodiment, the consumer care product is a top fill product, e.g. where the composition is filled into the product chamber 110 from the top of the package, comprising an antiperspirant or deodorant composition.

Ratchets have been previously used in dispensers as a separately molded part that is either inserted into the product chamber 110 after filling or is included within the product chamber 110 before the product chamber 110 is top-filled. Ratchets are often used for compositions that are top-filled such as with soft-solids and clear gels. Ratchets are often used for relieving pressure, dosing incrementally, and/or for providing audible feedback signal to the user.

In order to simplify the number of individually molded parts required and to promote flexibility for a variety of product offerings, in some examples, a non-removable ratchet 700 may be included at the lower end 240 of the outer jacket 200 or at the lower end 150 of the product chamber 110, as shown in FIGS. 1 and 5. Thus, in some examples, the mechanism for axially advancing a movable elevator platform (not shown) includes a screw assembly 330 and a ratchet 700 non-removably incorporated into the lower end 240 of the outer jacket 200 or at the lower end 150 of the product chamber 110, as shown in FIGS. 2, 5, 9, and 10. In some examples, the ratchet 700 at a lower end 240 of the outer jacket 200 or at the lower end 150 of the product chamber 110 is molded as a single part within the outer jacket 200 or the product chamber 110, as depicted in FIGS. 1, 2, 5, and 6.

Although the outer jacket 200 or the product chamber 110 may include a non-removable ratchet 700, the screw assembly 330 included in the dispensing package 100 may vary depending on the product form and the method of filing. In some examples, the dispensing package 100 may include a screw assembly 330 that includes at least one pawl 780 or may include a screw assembly 330 that does not include at least one pawl 780, but has a screw base 331 that allows for bottom filling, as depicted in FIGS. 9-16.

Figure 6:
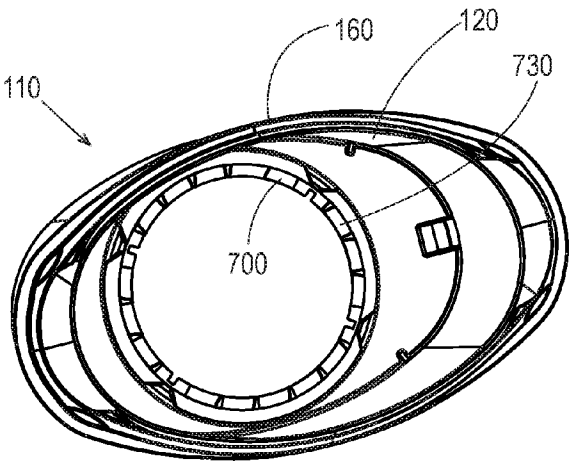
FIG. 6 is an enlarged view of an area within FIG. 5.

As shown in FIGS. 5 and 6, in some examples, the product chamber 110 may include a ratchet 700 located at the lower end 150 of the product chamber 110. The ratchet 700 may be designed to surround the bottom opening 170. The bottom opening 170 should be large enough to allow for bottom filling. In some examples, the diameter of the bottom opening 170 is about 22.79 mm or greater. In some examples, the diameter of the bottom opening 170 ranges from about 10 mm to about 50 mm.

Figure 8:
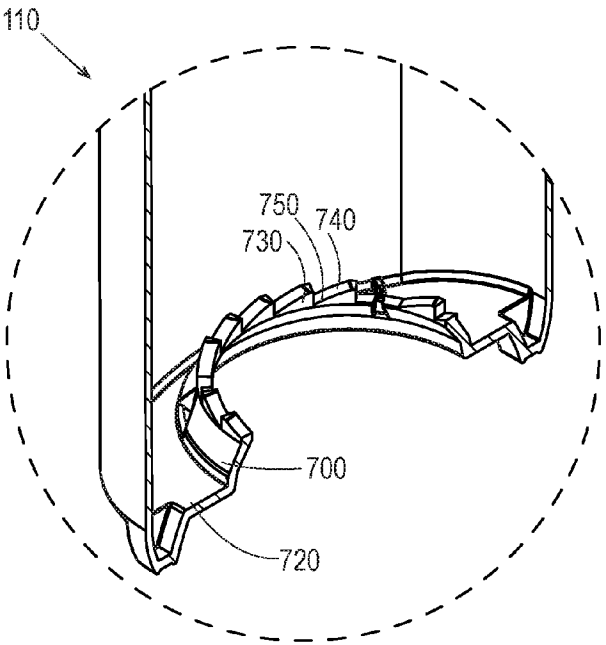
FIG. 8 is an enlarged, cross-sectional, perspective, side view of the product chamber of FIG. 5.
Figure 7:
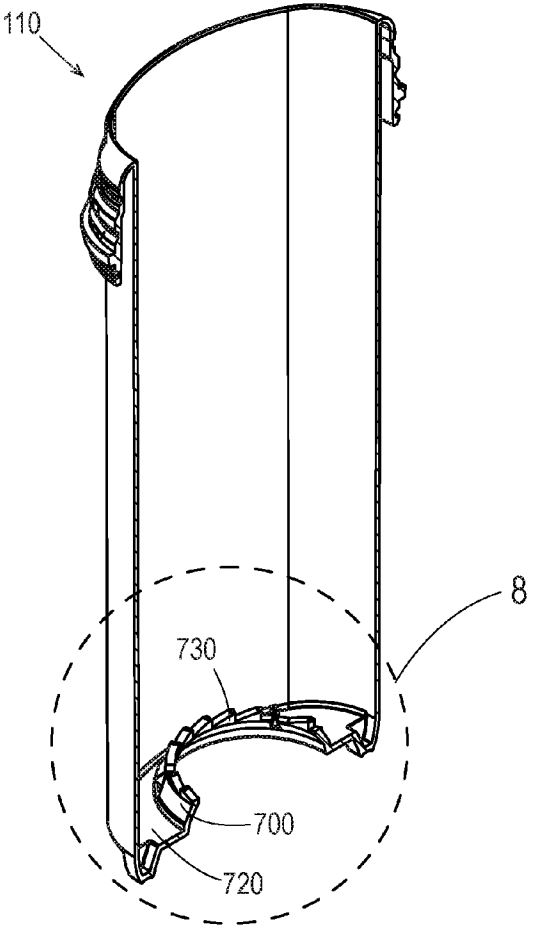
FIG. 7 is a cross-sectional, perspective, side view of the product chamber of FIG. 5.

As shown in FIGS. 7 and 8, a plurality of the one way ratchet teeth 730 may be rigidly affixed to the circumference of the ratchet 700. In some examples, two way ratchet teeth 730 may be used. As shown in FIGS. 7 and 8, the ratchet 700 may be raised above the interior floor 720 of the product chamber 110. In some examples, the ratchet 700 may include from about 8 to about 32 ratchet teeth 730, although the number of ratchet teeth 730 may be adapted to provide the desired dose/function. In some examples, the ratchet 700 includes from about 12 to about 20 ratchet teeth 730. The ratchet teeth 730 may include a face 740. The length of the face 740 may be from about 1 mm to about 2 mm in length. In some examples, the ratchet teeth 730 have a height, as measured from the base to the highest point, of about 0.254 mm to about 1.52 mm, alternatively from 0.51 mm to about 1.27 mm. In some examples, the ratchet teeth 730 are positioned in close proximity to each other so that the pawl 780 is able to move to the subsequent ratchet tooth 730 with ease. The ratchet teeth 730 may also have a lead angle 750 which may be from about 10 to about 50 degrees, alternatively from about 15 to about 35 degrees, alternatively from about 18 to about 25 degrees. In some examples, the lead angle 750 may be about 21. 5 degrees.

Figure 11:
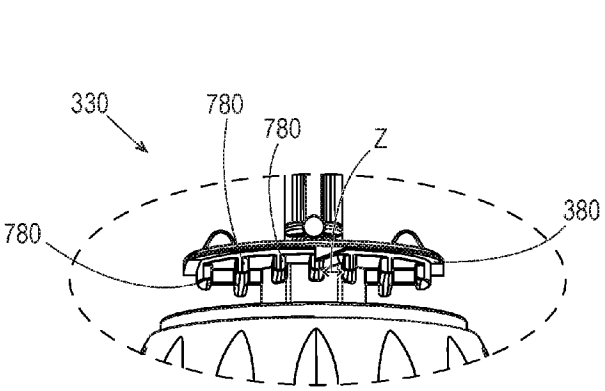
FIG. 11 is an enlarged view of an area within FIG. 10.
Figure 12:
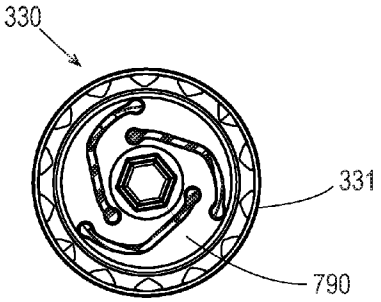
FIG. 12 is a bottom view of the screw assembly of FIG. 9.
Figure 10:
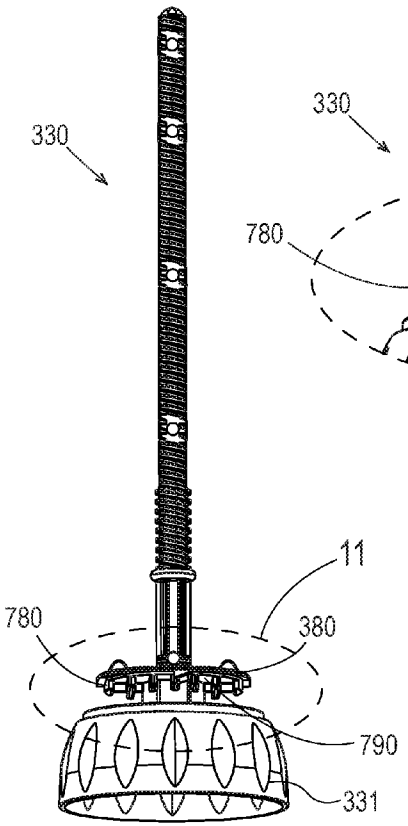
FIG. 10 is a perspective, back view of the screw assembly of FIG. 9.
Figure 9:
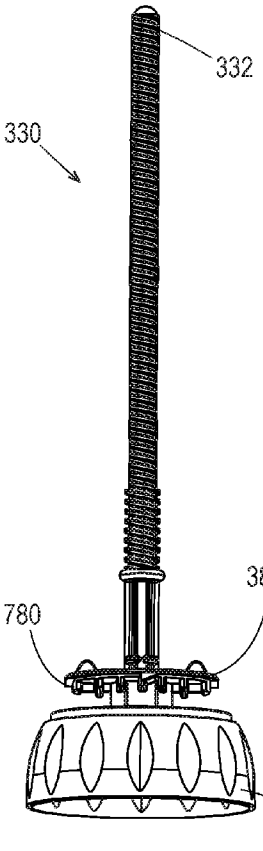
FIG. 9 is a perspective, front view of a screw assembly according to one or more embodiments shown and described herein.

As shown in FIGS. 9 and 10, in some examples, the screw assembly 330 may include a ratchet platform 380. The ratchet platform 380 may have a diameter of about 10 mm to about 40 mm. In some examples, the ratchet platform 380 has a diameter of about 25.15 mm. The ratchet platform 380 may be mounted to the screw assembly 330 or molded as a single part within the screw assembly 330. Because the ratchet platform 380 is fixed to the screw assembly 330, rotating the screw base 331 will likewise rotate the ratchet platform 380. The ratchet platform 380 may include a plurality of pawls 780. As shown in FIG. 11, in some examples, the pawls 780 may have a spacing Z between each pawl 780. In some examples, the size of the pawl 780, the number of pawls 780, and the spacing Z between the pawls 780 is engineered so that no more than one pawl 780 is operatively associated with any given face 740 when the screw base 331 is not being engaged by a user. In some examples, the spacing Z is from about 1 mm to about 25 mm. In some examples, the ratchet platform 380 includes from about 2 to about 10 pawls 780, alternatively from about 2 to about 4 pawls 780. In some examples, the ratchet 700 does not include any pawls 780. As shown in FIG. 12, when the ratchet platform 380 is included, the screw base 331 need not have an internal open configuration that allows for bottom filling such as when a closed end 790 is included because such a closed end 790 may restrict bottom filling.

Figure 15:
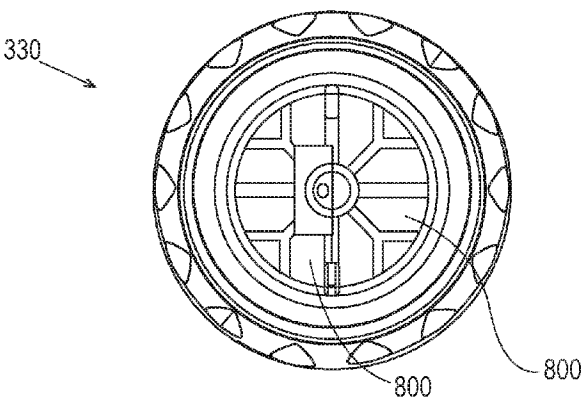
FIG. 15 is a top view of the screw assembly of FIG. 13.
Figure 16:
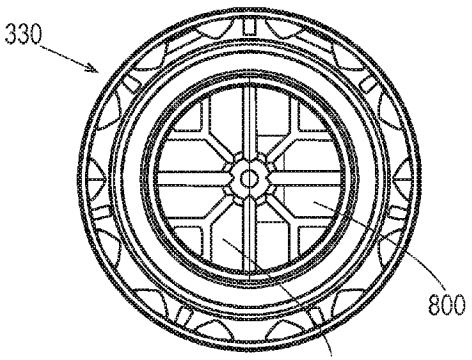
FIG. 16 is a bottom view of the screw assembly of FIG. 13.
Figure 14:
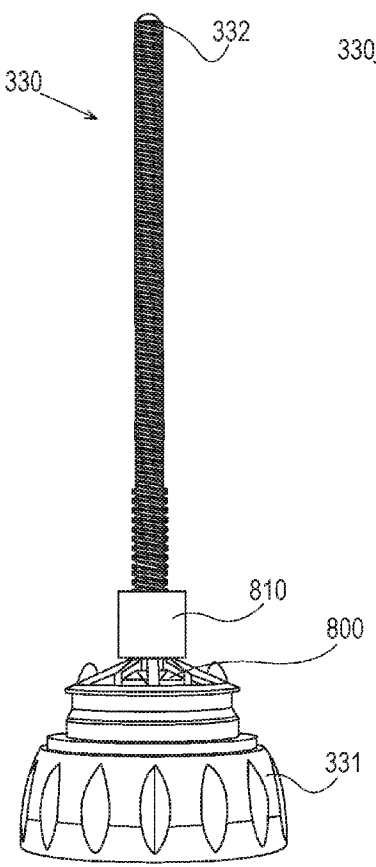
FIG. 14 is a back view of the screw assembly of FIG. 13.
Figure 13:
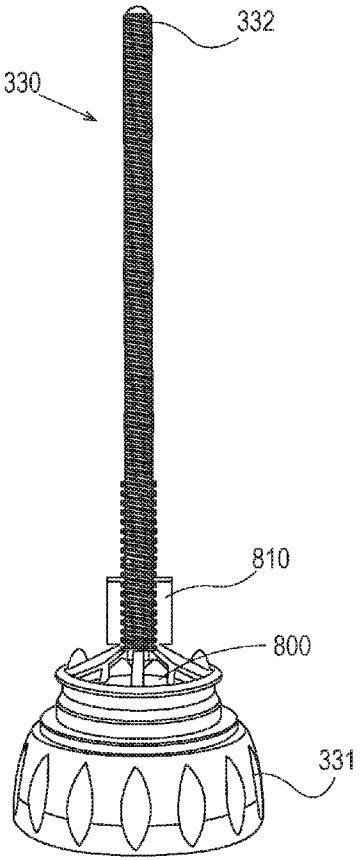
FIG. 13 is a perspective, front view of a screw assembly according to one or more embodiments shown and described herein.

As shown in FIGS. 13 and 14, in some examples, the screw assembly 330 may not include a ratchet platform 380. In some examples, the screw assembly 330 may include a bumper 810 that may be of any shape. In some examples, the bumper 810 is non-removably attached to at least one of the screw base 331 and the spindle 332. In some examples, the screw base 331 of the screw assembly 330 may be engineered to have an internal open configuration that allows for bottom filling. In some examples, the screw base 331 may include one or more apertures 800 to allow for bottom filling when the screw assembly 330 is to be incorporated into the dispensing package 100 that will be bottom filled. As shown in FIGS. 15 and 16, the screw base 331 may include numerous apertures 800 that should be engineered to provide little or no obstruction so as to have an internal open configuration that allows for bottom filling while also maintaining the structural integrity and stiffness between the screw base 331 and the spindle 332.

A variety of thermoplastic materials or rigid and semi-rigid materials can be used for the product chamber 110, the outer jacket 200, the screw assembly 330 (FIGS. 1-2), and/or other components of the package herein. For example, rigid and semi-rigid materials may include, but are not limited to, metals, including but not limited to, aluminum, magnesium alloy, steel; glass; including but not limited to, laminates and polymeric materials such as polypropylene (PP), polyethylene (PE), polystyrene (PS), polyethylene-terepthalate (PET), styrene-acrylonitrile copolymer (SAN), polyethylene-terepthalate copolymers, polycarbonate (PC), polyamides, acrylonitrile-butadiene-styrene (ABS), thermoplastic elastomers, polyoxymethylene copolymer and mixtures thereof.

In one embodiment, the molten thermoplastic material has a viscosity, as defined by the melt flow index (MFI) of about 0.1 g/0 min to about 500 g/10 min, as measured by ASTM D1238 performed at temperature of about 23° C. with a 2.16 kg weight. For example, for polypropylene, the melt flow index can be in a range of about 0.5 g/10 min to about 200 g/10 min. Other suitable melt flow indexes include about 1 g/10 min to about 400 g/10 min, about 10 g/10 min to about 300 g/10 min, about 20 to about 200 g/10 min, about 30 g/10 min to about 100 g/10 min, and about 50 g10 min to about 75 g/10 min. The MFI of the material is selected based on the application and use of the molded package. For example, thermoplastic materials with an MFI of about 5 g/10 min to about 50 g/10 min may be suitable for use as caps and closures for dispensing packaging.

In one embodiment the thermoplastic material can be, for example, a polyolefin. Illustrative polyolefins include, but are not limited to, polypropylene, polyethylene, polymethylpentene, and polybutene-1. Any of the aforementioned polyolefins could be sourced from bio-based feedstocks, such as sugarcane or other agricultural products, to produce a bio-polypropylene or bio-polyethylene.

Polyolefins advantageously demonstrate shear thinning when in a molten state. Shear thinning is a reduction in viscosity when the fluid is placed under compressive stress. Shear thinning can beneficially allow for the flow of the thermoplastic material to be maintained throughout the injection molding process. Without intending to be bound by theory, it is believed that the shear thinning properties of a thermoplastic material, and in particular polyolefins, results in less variation of the materials viscosity when the material is processed at lower pressures.

Other suitable thermoplastic materials include renewable polymers such as nonlimiting examples of polymers produced directly from organisms, such as polyhydroxyalkanoates (e.g., poly(beta-hydroxyalkanoate), poly(3-hydroxybutyrate-co-3-hydroxyvalerate, NODAX (Registered Trademark)), and bacterial cellulose; polymers extracted from plants, agricultural and forest, and biomass, such as polysaccharides and derivatives thereof (e.g., gums, cellulose, cellulose esters, chitin, chitosan, starch, chemically modified starch, particles of cellulose acetate), proteins (e.g., zein, whey, gluten, collagen), lipids, lignins, and natural rubber; thermoplastic starch produced from starch or chemically modified starch and polymers derived from naturally sourced monomers and derivatives, such as bio-polyethylene, bio-polypropylene, polytrimethylene terepthalate, polylactic acid, NYLON 11, alkyd resins, succinic acid-based polyesters, and bio-polyethylene terepthalate.

The suitable thermoplastic materials may include a blend or blends of different thermoplastic materials. For example, the blend may be a combination of materials derived from virgin bio-derived or petroleum-derived materials, or recycled materials of bio-derived or petroleum-derived materials. One or more of the thermoplastic materials in a blend may be biodegradable. Thermoplastic materials may be biodegradable.

The thermoplastic material can also be, for example, a polyester. Illustrative polyesters include, but are not limited to, polyethylene terepthalate (PET). The PET polymer could be sourced from bio-based feedstocks, such as sugarcane or other agricultural products, to produce a partially or fully bio-PET polymer. Other suitable thermoplastic materials include copolymers of polypropylene and polyethylene, and polymers and copolymers of thermoplastic elastomers, polyester, polystyrene, polycarbonate, poly(acrylonitrile-butadiene-styrene), poly(lactic acid), bio-based polyesters such as poly(ethylene furanate) polyhydroxyalkanoate, poly(ethylene furanoate), (considered to be an alternative to, or drop-in replacement for, PET), polyhydroxyalkanoate, polyamides, polyacetals, ethylene-alpha olefin rubbers, and styrene-butadiene-styrene block copolymers. The thermoplastic material can also be a blend of multiple polymeric and non-polymeric materials. The thermoplastic material can be, for example, a blend of high, medium, and low molecular polymers yielding a multi-modal or bi-modal blend. The multi-modal material can be designed in a way that results in a thermoplastic material that has superior flow properties yet has satisfactory chemo/physical properties. The thermoplastic material can also be a blend of a polymer with one or more small molecule additives. The small molecule could be, for example, a siloxane or other lubricating molecule that, when added to the thermoplastic material, improves the flowability of the polymeric material.

Polymeric materials may also include various fillers known to the skilled artisan, such as, for example, mica, interference pigments, wood flour; or materials that are capable of "blooming" to the surface of a molded component. Other additives may include inorganic fillers such calcium carbonate, calcium sulfate, talcs, clays (e.g., nanoclays), aluminum hydroxide, $CaSiO_3$, glass formed into fibers or microspheres, crystalline silicas (e.g., quartz, novacite, crystallobite), magnesium hydroxide, mica, sodium sulfate, lithopone, magnesium carbonate, iron oxide; or, organic fillers such as rice husks, straw, hemp fiber, wood flour, or wood, bamboo or sugarcane fiber.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer care product comprising a dispensing package, the dispensing package comprising:

a product chamber comprising a movable elevator platform operatively associated with a spindle of a screw assembly; and an outer jacket surrounding the product chamber, wherein the product chamber or the outer jacket comprises a ratchet non-removably associated with the outer jacket or the product chamber; and wherein the ratchet comprises teeth that have a lead angle from about 10 to about 50 degrees.

2. The consumer product of claim 1, wherein:

the product chamber further comprises a bottom opening for bottom filling; and the ratchet is non-removably associated with the product chamber.

3. The consumer product of claim 2, wherein the bottom opening has a diameter of about 10 mm to about 50 mm.

4. The consumer product of claim 2, wherein the ratchet is located at a lower end of the product chamber and surrounds the bottom opening.

5. The consumer product of claim 1, wherein the ratchet comprises a plurality of ratchet teeth that are rigidly affixed to the circumference of the ratchet.

6. The consumer product of claim 5, wherein the ratchet teeth are raised above the interior floor of the product chamber.

7. The consumer product of claim 1, wherein the ratchet comprises a plurality of ratchet teeth.

8. The consumer product of claim 1, wherein the ratchet comprises 8 to 23 ratchet teeth, each ratchet tooth having a lead angle of about 10 degrees to about 50 degrees.

9. The consumer product of claim 1, wherein the ratchet comprises 12 to 20 ratchet teeth, each ratchet tooth having a lead angle of about 15 degrees to about 25 degrees.

10. The consumer product of claim 1, wherein the ratchet is molded as a single part within the outer jacket or the product chamber.

11. The consumer product of claim 1, wherein:

the product chamber further comprises a bottom opening for bottom filling and a ratchet non-removably associated with the product chamber; and the ratchet is molded as a single part within the outer jacket or the product chamber.

12. The consumer product of claim 1, wherein:

the screw assembly comprises a ratchet platform that is fixed to the screw assembly; and the ratchet platform comprises at least one pawl.

13. The consumer product of claim 12, wherein the ratchet platform comprises from 2 to 10 pawls.

14. The consumer product of claim 12, wherein the screw assembly (330) comprises a screw base (331) that does not have an internal open configuration that allows for bottom filling.

15. The consumer product of claim 1, wherein the screw assembly does not comprise a ratchet platform.

16. The consumer product of claim 1, wherein the screw assembly comprises a screw base that has an internal open configuration that allows for bottom filling.

17. The consumer product of claim 16, wherein the screw assembly further comprises a plurality of apertures that allow for bottom filling.

18. The consumer product of claim 1, wherein the screw assembly is removably attached to the product chamber.

19. The consumer product of claim 1, wherein the product chamber further comprises an antiperspirant or deodorant.

20. A consumer care product comprising a dispensing package, the dispensing package comprising:

a product chamber comprising a movable elevator platform operatively associated with a spindle of a screw assembly;

wherein the product chamber comprises a ratchet non-removably associated with the product chamber; and wherein the ratchet comprises teeth that have a lead angle from about 10 to about 35.

* * * * *